US008678106B2

(12) United States Patent
Matsunaga et al.

(10) Patent No.: US 8,678,106 B2
(45) Date of Patent: Mar. 25, 2014

(54) ROTARY IMPACT TOOL

(75) Inventors: Yutaka Matsunaga, Anjo (JP); Hirokatsu Yamamoto, Anjo (JP); Katsuna Hayashi, Anjo (JP); Yoshitaka Ichikawa, Anjo (JP)

(73) Assignee: Makita Corporation, Anjo-shi (JP)

( * ) Notice: Subject to any disclaimer, the term of this patent is extended or adjusted under 35 U.S.C. 154(b) by 228 days.

(21) Appl. No.: 13/203,936

(22) PCT Filed: Jan. 14, 2010

(86) PCT No.: PCT/JP2010/050314

§ 371 (c)(1),
(2), (4) Date: Sep. 12, 2011

(87) PCT Pub. No.: WO2010/103863

PCT Pub. Date: Sep. 16, 2010

(65) Prior Publication Data

US 2011/0315417 A1 Dec. 29, 2011

(30) Foreign Application Priority Data

Mar. 10, 2009 (JP) ..... 2009-056069

(51) Int. Cl.
*B25B 21/02* (2006.01)

(52) U.S. Cl.
USPC ..... 173/176; 173/2; 173/93.5; 173/181; 173/183; 173/217

(58) Field of Classification Search
USPC ..... 173/2, 4, 176, 178, 181, 183, 217, 109, 173/93, 93.5, 216, 48; 73/11.04, 12.01, 73/35.09, 862.23; 81/467, 469
See application file for complete search history.

(56) References Cited

U.S. PATENT DOCUMENTS 5,563,482 A * 10/1996 Shaw et al. ..... 318/272
6,371,218 B1 * 4/2002 Amano et al. ..... 173/183

(Continued)

FOREIGN PATENT DOCUMENTS

CN 1306354 C 3/2007
JP A-07-116969 5/1995

(Continued)

OTHER PUBLICATIONS

International Search Report in International Application No. PCT/JP2010/050314; dated Mar. 23, 2010 (with English-language translation).

(Continued)

*Primary Examiner* — Scott A. Smith
(74) *Attorney, Agent, or Firm* — Oliff PLC

(57) ABSTRACT

A rotary impact tool includes: a hammer rotating by receiving a rotational force of a motor; an anvil rotating by receiving a rotational force of the hammer; and an end tool attached to the anvil, the rotary impact tool being constructed such that when a torque of a value not less than a predetermined value is applied to the anvil from the outside, the hammer is disengaged from the anvil to rotate idle and applies an impact to the anvil in a rotational direction after rotating idle by a predetermined angle, the rotary impact tool including an impact detector configured to detect impacts and a speed switching device configured to switch the rotational speed of the motor, and when the impact detector detects an impact during rotation of the anvil in a tightening direction, the speed switching device switches the rotational speed of the motor from a normal speed to a low speed.

7 Claims, 4 Drawing Sheets

(56) References Cited

U.S. PATENT DOCUMENTS

| | | | | |
|---|---|---|---|---|
| 6,536,536 | B1 * | 3/2003 | Gass et al. | 173/2 |
| 6,607,041 | B2 * | 8/2003 | Suzuki et al. | 173/4 |
| 6,848,516 | B2 * | 2/2005 | Giardino | 173/2 |
| 6,945,337 | B2 * | 9/2005 | Kawai et al. | 173/183 |
| 6,968,908 | B2 * | 11/2005 | Tokunaga et al. | 173/181 |
| 7,036,605 | B2 * | 5/2006 | Suzuki et al. | 173/20 |
| 7,419,013 | B2 * | 9/2008 | Sainomoto et al. | 173/181 |
| 7,428,934 | B2 * | 9/2008 | Arimura | 173/181 |
| 7,726,412 | B2 * | 6/2010 | Matsunaga | 173/2 |
| 7,896,098 | B2 * | 3/2011 | Suzuki et al. | 173/112 |
| 2002/0050364 | A1 | 5/2002 | Suzuki et al. | |
| 2004/0144552 | A1 | 7/2004 | Suzuki et al. | |
| 2005/0109520 | A1 | 5/2005 | Kawai et al. | |
| 2006/0118315 | A1 | 6/2006 | Suzuki et al. | |

FOREIGN PATENT DOCUMENTS

| | | |
|---|---|---|
| JP | A-09-155755 | 6/1997 |
| JP | A-10-151578 | 6/1998 |
| JP | A-2001-260042 | 9/2001 |
| JP | A-2001-341079 | 12/2001 |
| JP | A-2007-001013 | 1/2007 |
| JP | A-2008-213089 | 9/2008 |
| JP | A-2008-221372 | 9/2008 |
| JP | A-2008-278633 | 11/2008 |

OTHER PUBLICATIONS

Mar. 12, 2013 Office Action issued in Japanese Patent Application No. 2009-056069; with English-language translation.

Extended European Search Report issued in European Patent Application No. 10750619.8 dated May 10, 2013.

May 17, 2013 Notification of the First Office Action issued in Chinese Application No. 201080011394.0 with English-language translation.

* cited by examiner

ROTARY IMPACT TOOL

TECHNICAL FIELD

The present invention relates to a rotary impact tool that has a hammer rotating by receiving the rotational force of a motor, an anvil rotating by receiving the rotational force of the hammer, and an end tool attached to the anvil and is constituted such that when a torque of a value not less than a predetermined value is applied to the anvil from the outside, the hammer is detached from the anvil to rotate idle and applies an impact to the anvil in the rotational direction after rotating idle by a predetermined angle.

BACKGROUND ART

A pertinent conventional rotary impact tool is disclosed in Japanese Laid-Open Patent Publication No. 2001-260042 (Japanese Patent No. 3670189).

The rotary impact tool disclosed in this publication is an impact driver, which is configured to allow setting of the number of times that the hammer apply impacts to the anvil so that a number of screws or the like can be tightened with the same torque. More specifically, the impact driver has a piezoelectric buzzer detecting the impact sound of the hammer on the anvil, a setting dial for setting the number of impacts, and a motor control unit. And, at a stage where impacts have been applied by a set number of times during the tightening of screws, the motor control unit stops the motor. This enables a number of screws or the like to be tightened with the same torque.

However, If the kind of screws and the material, thickness, dimension, etc. of a plate material to which the screws are tightened are changed, it is necessary to change the tightening torque, and therefore, each time they are change, the number of impacts must be reset.

As shown in FIG. 5, in the case that a tex screw (registered trademark) 3, whose front end portion is formed as a drill gimlet, is used, holes are to be formed in plate materials 4 and 5, so that it is necessary to rotate the end tool of the impact driver at high speed. As a result, the interval between the impacts after seating of the tex screw 3 is very short. Thus, it is difficult to set a proper number of impacts; further, since the rotation of the hammer is at high speed, the impact force is also increased. This may lead to decapitation or the like, in which the head of the tex screw 3 is torn off.

Further, in the case that the tightening completing timing (motor stopping timing) is determined based on the judgment by the operator regardless of the number of impacts, it is difficult to determine the tightening completing timing if the interval between the impacts is very short, and unintended impacts are applied, decapitation or the like, in which the head of the tex screw 3 is torn off, is likely to be caused.

Therefore, there is a need in the art to reduce the impact force and to make the interval between impacts relatively long, thereby preventing decapitation or the like of a screw, even in the event that it is necessary to rotate a screw or the like at high speed.

SUMMARY OF THE INVENTION

In one aspect of the present invention, a rotary impact tool includes: a hammer rotating by receiving a rotational force of a motor; an anvil rotating by receiving a rotational force of the hammer; and an end tool attached to the anvil, the rotary impact tool being constructed such that when a torque of a value not less than a predetermined value is applied to the anvil from the outside, the hammer is disengaged from the anvil to rotate idle and applies an impact to the anvil in a rotational direction after rotating idle by a predetermined angle, characterized by including an impact detection means detecting impacts and a speed switching means switching the rotational speed of the motor, wherein when the impact detection means detects start of an impact during rotation of the anvil in a tightening direction, the speed switching means switches the rotational speed of the motor from a normal speed to a low speed.

Therefore, even in the case that, for example, a screw or the like is being tightened at the normal speed (high speed), the rotational speed of the motor is switched to the low speed once start of the impact is detected. As a result, the impact force of the hammer with respect to the anvil is reduced, and the interval between impacts is made relatively long.

That is, even in the case that a screw or the like is being tightened at a high speed, the impact force can be made relatively small, and the interval between impacts can be made relatively long. Therefore, it is easy to determine the tightening timing based on the judgment by the operator, and no unintended excessive impact operation occurs, so that it is possible to preventing a trouble such as screw decapitation.

Further, since a screw or the like can be tightened at a high speed, it is possible to prevent deterioration in work efficiency.

In a second aspect of the present invention, it is characterized by including a speed adjusting mechanism capable of adjusting between 0 and a predetermined value a difference between the normal speed and the low speed.

Thus, it is possible to set the difference between the normal speed and the low speed to an appropriate value according to the size and kind of the screw, and the material, etc. of a plate material to which the screw is to be fixed.

In a third aspect of the present invention, the rotary impact tool includes a main switch adjusting the rotating speed of the motor according to a pulling amount of a trigger, and the rotary impact tool is constructed such that both in the case that the motor is switched to the normal speed and in the case that the motor is switched to the low speed, the rotational speed of the motor can be adjusted according to the pulling amount of the trigger.

That is even in the case that the motor is switched to the low speed, it is possible to adjust the rotational speed of the motor, so that it is easy to adjust the interval between impacts.

In a fourth aspect of the present invention, the impact detection means is constructed such that impacts can be detected by a piezoelectric sensor or an acceleration sensor.

According to the invention of claim 5, during the rotation of the anvil in a direction opposite to the tightening direction, the speed switching means does not switch the rotational speed of the motor even in the case that the impact detection means detects an impact.

As a result, a screw or the like can be loosened quickly.

DETAILED DESCRIPTION OF THE INVENTION

Embodiment 1

Figure 1:
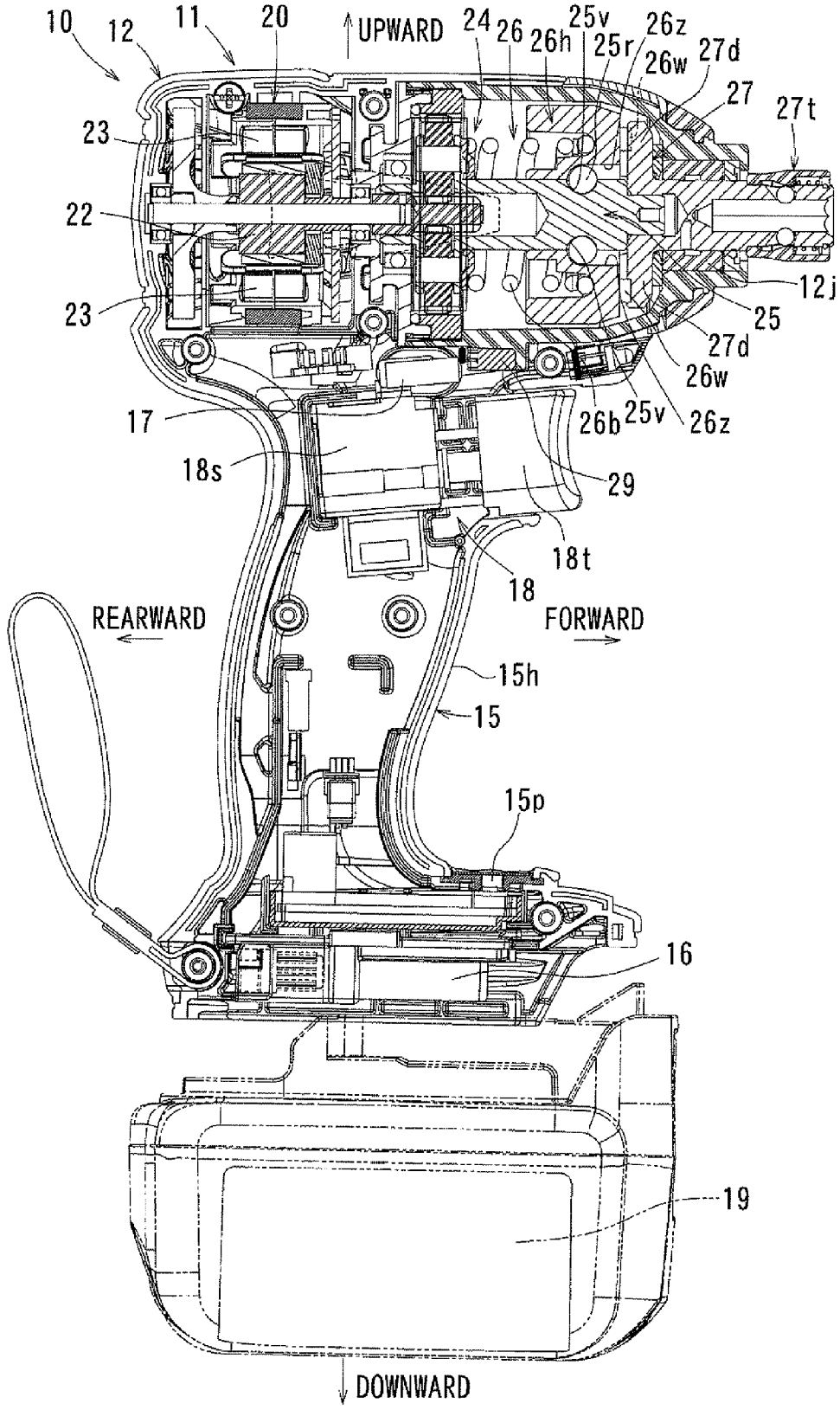
FIG. 1 A general vertical sectional view of a rotary impact tool according to Embodiment 1 of the present invention, FIG. 2 A schematic diagram illustrating the construction of a motor driving circuit of the rotary impact tool.

In the following, a rotary impact tool according to Embodiment 1 of the present invention will be described with reference to FIGS. 1 through 5. The rotary impact tool of the present embodiment is an impact driver (hereinafter referred to as rotary impact tool) using a DC brushless motor as a drive source.

Here, forward, rearward, rightward, and leftward indicated in the drawings correspond to forward, rearward, rightward, and leftward with respect to the rotary impact tool.

Outline of the Rotary Impact Tool

As shown in FIG. 1, a housing 11 of a rotary impact tool 10 according to the present embodiment is constituted by a tubular housing main body 12, and a grip portion 15 formed so as to protrude from a lateral portion (lower portion in FIG. 1) of the housing main body 12.

The housing main body 12 coaxially accommodates a DC brushless motor 20, a planetary gear mechanism 24, a spindle 25, an impact force generation mechanism 26, and an anvil 27 in this order from the rear side. The DC brushless motor 20 serves as a drive source of the rotary impact tool 10; the rotation of the DC brushless motor 20 is reduced in speed by the planetary gear mechanism 24, and then transmitted to the spindle 25. And, the rotational force of the spindle 25 is converted into a rotational impact force by the impact force generation mechanism 26 having a hammer 26*h*, a compression spring 26*b*, etc. as will be described below, and is transmitted to the anvil 27. The anvil 27 is a portion which rotates about an axis by receiving the rotational impact force; it is supported by a bearing 12*j* disposed at the front end of the housing main body 12 so as to be rotatable about the axis and as not to be capable of displacement in the axial direction.

At the front end portion of the anvil 27, there is provided a chuck portion 27*t* for attaching a driver bit, a socket bit and the like (not shown).

That is, the driver bit, socket bit or the like mentioned above corresponds to the end tool of the present invention.

The grip portion 15 of the housing 11 is a portion to be grasped by the operator when using the rotary impact tool 10; it is constituted by a handle portion 15*h*, and a lower end portion 15*p* situated on the protruding end (lower end) side of the handle portion 15*h*. The handle portion 15*h* is formed to have a relatively small diameter so that the operator can easily grasp it, and a trigger-type main switch 18 is disposed at the base end portion of the handle portion 15*h*. The main switch 18 has a trigger 18*t* to be pulled by a fingertip of the operator, and a switch main body portion 18*s* whose contact is turned on/off through the pulling operation on the trigger 18 and which is configured to undergo a change in resistance value according to the pulling amount of the trigger 18*t*.

Further, on the upper side of the main switch 18, there is provided a normal/reverse changing switch 17 for changing the rotational direction of the DC brushless motor 20.

The lower end portion 15*p* of the grip portion 15 is formed so as to enlarge mainly downwardly forwards from the handle portion 15*h*; on the lower side of the lower end portion 15*p*, there is provided a battery pack connection portion 16 to which a battery pack 19 is connected. The battery pack connection portion 16 is formed like an inverted recess having an inverted U-shaped sectional configuration, and a fitting portion (not shown) of the battery pack 19 is fitted with the battery pack connection portion 16 as it is slide from the front side toward the rear side.

Regarding Impact Force Generation Mechanism 26

As shown in FIG. 1, the hammer 26*h* of the impact force generation mechanism 26 is connected with the spindle 25 via V-shaped cam grooves 25*v*, V-shaped guide grooves 26*z*, and steel balls 25*r*.

That is, in the front portion of the outer peripheral surface of the spindle 25, there are formed, at two positions in the circumferential direction of the spindle 25, the V-shaped cam grooves 25*v* having a semi-circular sectional configuration, with their V-shaped openings being directed rearward. Further, in the inner peripheral surface of the hammer 26*h*, there are formed, at positions opposed to the V-shaped cam grooves 25*v* of the spindle 25, the V-shaped guide grooves 26*z* having a semi-circular sectional configuration, with their V-shaped openings being directed forwardly. And, the steel balls 25*r* are fitted between the V-shaped cam grooves 25*v* and the V-shaped guide grooves 26*z* opposed to each other. As a result, the hammer 26*h* is connected so as to be rotatable by a given angle from a reference position with respect to the spindle 25, and so as to be capable of relative movement in the axial direction by a given distance with respect thereto. Further, attached to the periphery of the spindle 25 is a compression spring 26*b* urged so as to push the hammer 26*h* forwards (toward the reference position) with respect to the spindle 25.

At the front end surface of the hammer 26*h*, there are formed impact protrusions 26*w* for applying an impact to the anvil at two positions spaced by 180° in the circumferential direction. Further, the anvil 27 has, at two positions spaced by 180° in the circumferential direction, impact arms 27*d* configured to allow abutment of the impact protrusions 26*w* of the hammer 26*h*. And, with the hammer 26*h* being retained at the front end position of the spindle 25 by the spring force of the compression spring 26*b*, the respective impact protrusions 26*w* of the hammer 26*h* abut the impact arms 27*d* of the anvil 27. When, in this state, the spindle 25 is rotated by the rotational force of the DC brushless motor 20, the hammer 26*h* rotates together with the spindle 25, and the rotational force of the hammer 26*h* is transmitted to the anvil 27 via the impact protrusions 26*w* and the impact arms 27*d*. And, a screw, for example, is tightened by a driver bit or the like attached to the anvil 27.

And, when the screw has been tightened to a predetermined position, and a torque of not less than a predetermined value is applied to the anvil 27 from the outside, the rotational force (torque) of the hammer 26*h* with respect to the anvil 27 is of not less than a predetermined value. As a result, the hammer 26 is displaced backwards with respect to the spindle 25 against the spring force of the compression spring 26*b*, and the impact protrusions 26*w* of the hammer 26*b* get over the impact alms 27*d* of the anvil 27. That is, the impact protrusions 26*w* of the hammer 26*b* are disengaged from the impact arms 27*d* of the anvil 27 and rotate idle. When the impact protrusions 26*w* of the hammer 26*b* get over the impact arms 27*d* of the anvil 27, the hammer 26*b* is caused to advance by the spring force of the compression spring 26*b*, and rotates idles by a predetermined angle; then, the impact protrusions 26*w* of the hammer 26*b* apply an impact to the impact arms 27*d* of the anvil 27 in the rotational direction. As a result, the screw is tightened with high torque. And, the idle rotation of the hammer 26*b* and the impacting operation of the hammer 26*b* to the anvil 27 are repeated.

That is, when a torque of not less than a predetermined value (not less than an impact start torque) is applied to the anvil 27, the impact operation is repeatedly performed on the anvil 27 by the hammer 26*h*, so that the screw is tightened with high torque.

Here, as shown in FIG. 1, inside the housing 11, there is provided, at a position on the upper side of the main switch 18 and in front of the normal/reverse changing switch 17, an impact sensor 29 for detecting impacts of the hammer 26*h* applied to the anvil 27. As the impact sensor 29, a piezoelectric impact sensor or an acceleration sensor may be used.

Regarding DC Brushless Motor 20 and Motor Driving Circuit 40

Figure 2:
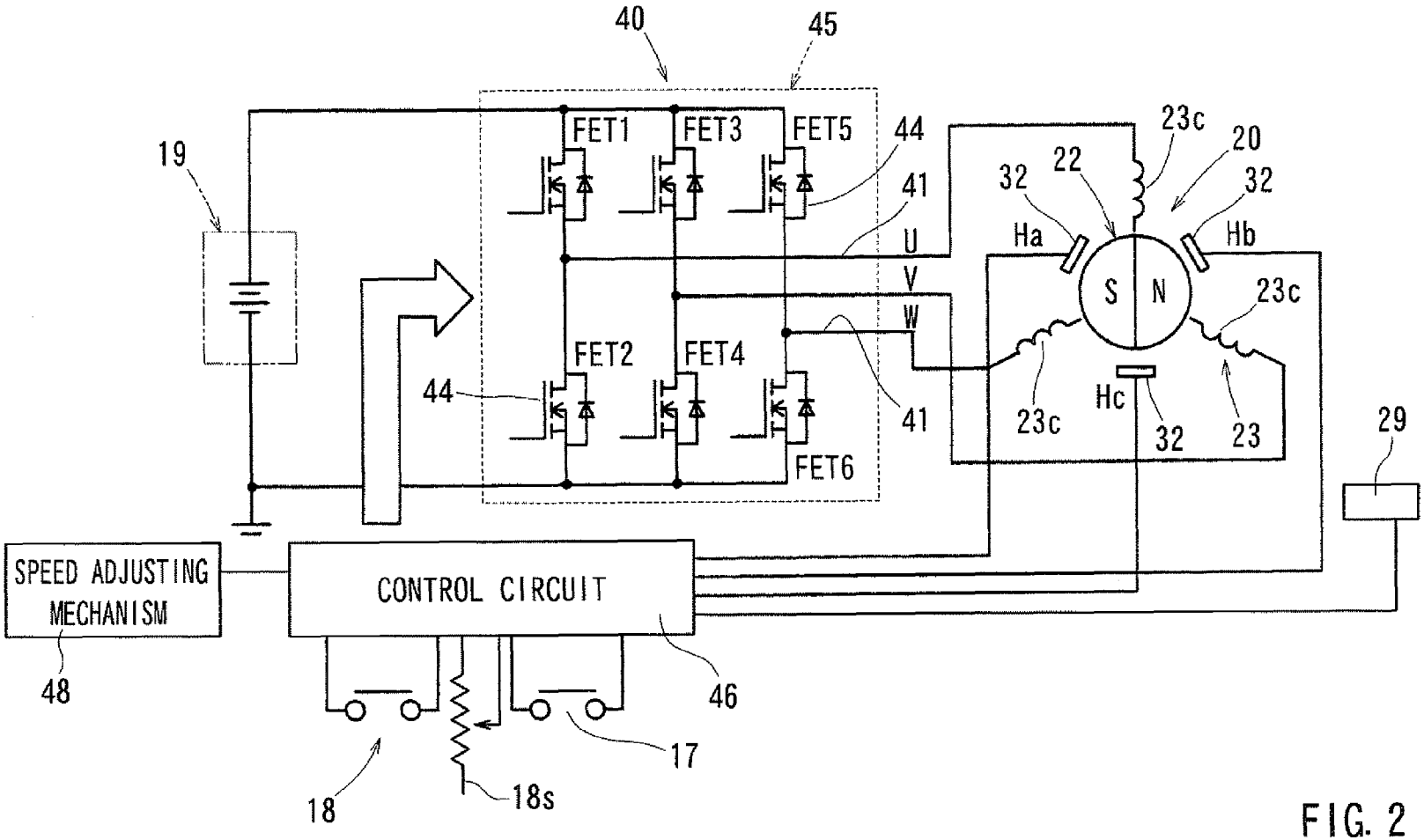

As shown in FIG. 2, etc., the DC brushless motor 20 is constituted by a rotor 22 having permanent magnets, a stator 23 having driving coils 23*c*, and three magnetic sensors 32 for detecting the positions of magnetic poles of the rotor 22.

The motor driving circuit 40 is an electric circuit for driving the DC brushless motor 20; as shown in FIG. 2, it has a three-phase bridge circuit portion 45 composed of six switching elements 44 (FETs 1 through 6), and a control circuit 46 controlling the switching elements 44 of the three-phase bridge circuit portion 45 based on a signal from the main switch 18.

The three-phase bridge circuit portion 45 has three (U-phase, V-phase, and W-phase) output lines 41, which are connected to the corresponding driving coils 23*c* (U-phase, V-phase, and W-phase) of the brushless motor 20.

When the trigger 18*t* of the main switch 18 is turned on, the control circuit 46 operates the switching elements 44 (FETs 1 through 6) based on signals from the magnetic sensors 32 to cause electric current to sequentially flow through the driving coils 23*c*, so that the rotor 22 rotates.

Figure 3:
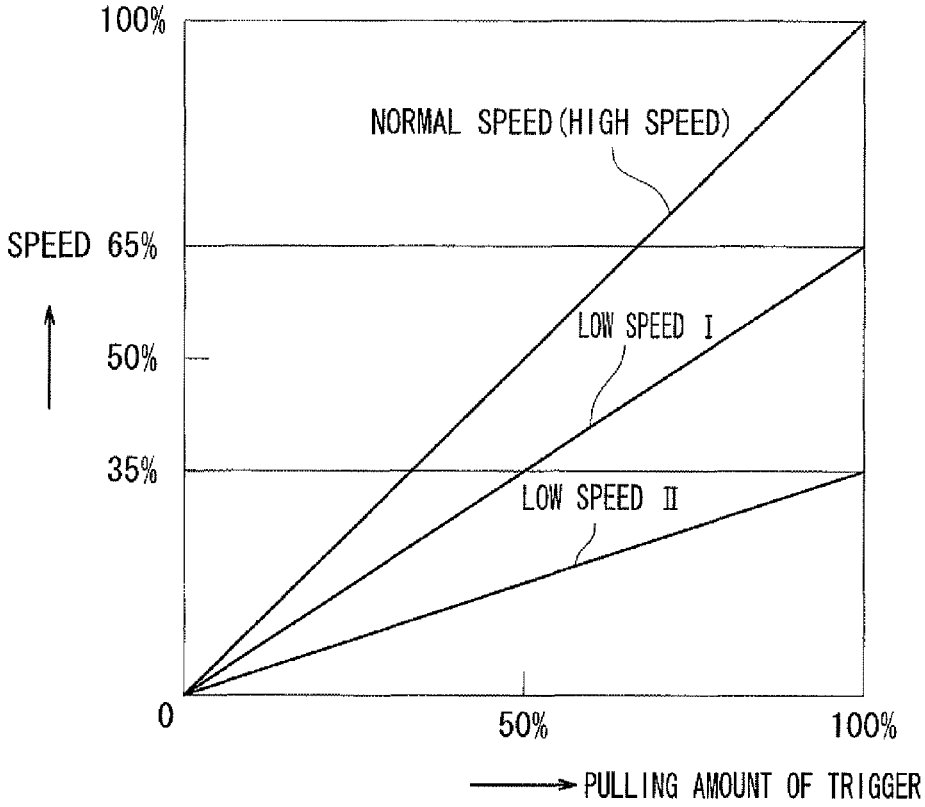
FIG. 3 A graph illustrating how the speed of the rotary impact tool is switched.

When the resistance value of the switch main body portion 18*s* changes according to the pulling amount of the trigger 18*t* of the main switch 18, the control circuit 46 can adjust the power supplied to the U-phase, V-phase, and W-phase driving coils 23*e* through PWM control based on the change in the resistance value. More specifically, the power supplied to each driving coil 23*c* is PWM-controlled through duty ratio adjustment of FET 2, FET 4, and FET 6 of the three-phase bridge circuit portion 45 at a predetermined carrier frequency. As a result, as shown in FIG. 3, the rotational speed of the DC brushless motor 20 increases according to the pulling amount of the trigger 18*t* of the main switch 18.

Further, as shown in FIG. 2, a speed adjusting mechanism 48, such as a switch, a dial or the like is connected to the control circuit 46; the control circuit 46 is configured to be able to set the speed of the DC brushless motor 20 based on a signal from the speed adjusting mechanism 48. And, when the impact sensor 29 detects an impact of the hammer 26*h* to the anvil 27, the control circuit 46 switches the rotational speed of the DC brushless motor 20 from a normal speed (high speed) to low speed I or low speed II based on the signal from the impact sensor 29. Here, setting is made such that, at low speed I, the rotational speed of the DC brushless motor 20 is, for example, approximately 65% of the normal speed. Further, setting is made such that, at low speed II, the rotational speed of the DC brushless motor 20 is, for example, approximately 35% of the normal speed.

That is, the impact sensor 29 corresponds to the impact detection means of the present invention, and the control circuit 46 corresponds to the speed switching means of the present invention.

Regarding Operation of Rotary Impact Tool 10 of Present Embodiment

Next, the operation of the rotary impact tool 10 of the present embodiment will be described with reference to the flowchart in FIG. 4.

Figure 4:
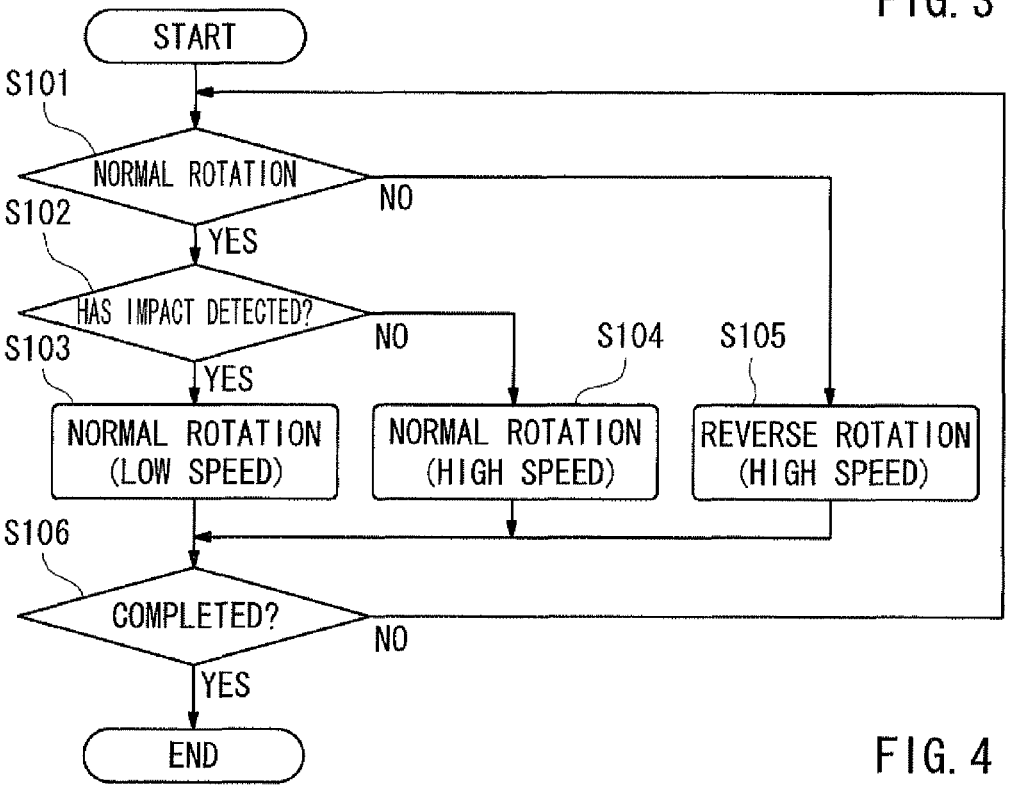
FIG. 4 A flowchart illustrating the operation of the rotary impact tool.
Figure 5:
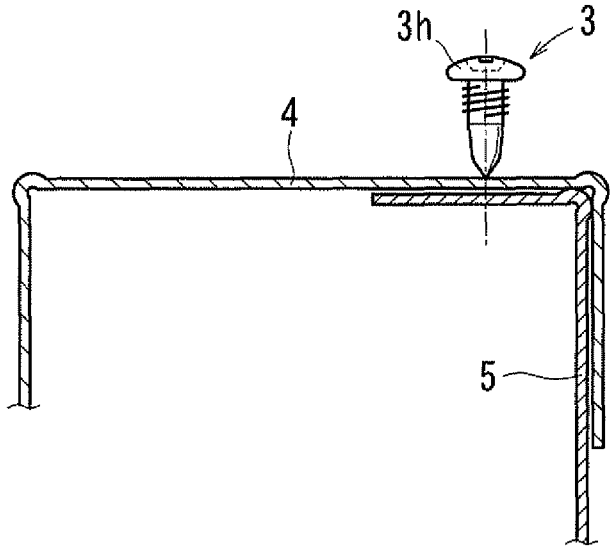
FIG. 5 A schematic side view illustrating how plate members are fixed to each other by utilizing a tex screw.

As shown in FIG. 5, in the case where the plate members 4 and 5 are joined to each other by using the tex screw 3, the tex screw 3 is rotated in the tightening direction (normal direction), so that the determination made in step S101 in FIG. 4 is YES. At the stage where holes are formed in the plate members 4 and 5 by the tex screw 3, no impact is detected (NO in step S102), so that the DC brushless motor 20 rotates at the normal speed (high speed) (step S104). That is, based on the characteristics of the normal speed as shown in FIG. 3, the DC brushless motor 20 rotates according to the pulling amount of the trigger 18*t* of the main switch 18.

And, step S106 (NO), step S101, step S102, step S104, and step S106 (NO) in FIG. 4 are repeatedly executed, whereby the formation of holes in the plate members 4 and 5 and the screwing of the tex screw 3 are performed, with the DC brushless motor 20 rotating at the normal speed (high speed).

And, the head portion 3*h* of the tex screw 3 is, for example, brought into contact with (seated on) the surface of the plate member 4 to thereby apply a torque of not less than a predetermined value (not less than the striking start torque) to the anvil 27; then, an impact is applied to the anvil 27 by the hammer 26*h*. And, when the start of the impacting is detected by the impact sensor 29 (YES in step S102), the rotational speed of the DC brushless motor 20 is switched to low speed I or low speed II (step S103). That is, based on the characteristics of low speed I or low speed II as shown in FIG. 3, the DC brushless motor 20 is rotated according to the pulling amount of the trigger 18*t* of the main switch 18. In this way, if the impact is once detected, the rotational speed of the DC brushless motor 20 is switched to a low speed, so that the impact force is reduced, and the interval between impacts becomes longer.

And, at the time when the operator determines that the tightening of the tex screw 3 has been completed (YES in step S106), the pulling amount of the trigger 18*t* is reduced to zero to complete the screw tightening operation.

Here, it is previously set based on the size, material, etc. of the tex screw 3 whether the rotational speed of the DC brushless motor 20 is to be switched to low speed I or low speed II.

When removing the tex screw 3 screwed into the plate members 4 and 5, the DC brushless motor 20 is rotated in the reverse direction (NO in step S101). As a result, the DC brushless motor 20 rotates at the normal speed (high speed) to loosen the tex screw 3. Even in the case that the impacting operation has been made at that time, the rotational speed of the DC brushless motor 20 is maintained at the normal speed (high speed).

Advantages of the Rotary Impact Tool 10 of the Present Embodiment

According to the rotary impact tool 10 of the present embodiment, even in the case that the hole-forming operation and the tightening operation of the tex screw 3 are performed at the normal speed (high speed), the rotational speed of the DC brushless motor 20 is switched to the low speed once the impact is detected. Thus, the impact force of the hammer 26*h* applied to the anvil 27 is reduced, and the interval between impacts becomes relatively long.

That is, even in the case that the hole-forming operation and the tightening operation of the tex screw 3 are performed at a high speed, it is possible to reduce the impact force and to make the interval between impacts relatively long. Thus, it is easier for the operator to determine the timing of completion of the tightening operation, and no unintended excessive impact may occur. Thus, it is possible to avoid troubles such as decapitation of the screw head.

Further, since the hole-forming and tightening operations can be performed at a high speed, it is possible to prevent deterioration in operational efficiency.

Further, the control circuit 46 is constructed such that it is possible to adjust the difference between the normal speed (high speed) and the low speed in a plurality of stages, it is possible to set the difference between the normal speed and the low speed to a proper value according to the size and kind of the screw and the material, etc. of the plate member to which the screw is to be fixed.

Further, in both the case in which the DC brushless motor 20 is switched to the normal speed and the case in which it is switched to the low speed, it is possible to adjust the rotational speed of the motor according to the pulling amount oft the trigger 18*t* of the main switch 18. Thus, it is further easier to adjust the interval between impacts, with the DC brushless motor 20 switched to the low speed.

Further, it is constructed such that when the anvil 27 (the DC brushless motor 20) is being rotated in a direction opposite to the tightening direction, the control circuit 46 does not switch the rotational speed of the DC brushless motor 20 even if the impact sensor 29 detects an impact, so that it is possible to quickly loosen the screw or the like.

Modifications

Here, the present invention is not limited to the above-described embodiment but allows modifications without a range that does not depart from the gist of the invention. For example, while in the above-described embodiment an impact applied to the anvil 27 by the hammer 26*h* is detected by the impact sensor 29 (a piezoelectric sensor or an acceleration sensor), it is also possible to use, instead of the impact sensor 29, a piezoelectric buzzer or a microphone configured to detect impact sound. Further, it is also possible to detect an impact from change in the current value of the DC brushless motor 20, and it is also possible to compute the rotational speed of the DC brushless motor 20 based on the time it takes one magnetic sensor 32 to be turned on after the magnetic sensor 32 adjacent thereto is turned on, in order to detect an impact from a change in the rotational speed.

Further, while in the above-described example the rotational speed of the DC brushless motor 20 is switched from the normal speed to low speed I or low speed II, it is also possible to increase the kinds of low speed. Further, depending upon the size and material of the screw or the like, it is also possible to prevent the rotational speed of the DC brushless motor 20 from being changed from the normal speed even in the case that an impact is detected.

Further, while in the above-described example low speed I is set to approximately 65% of the normal speed, and low speed II is set to approximately 35% of the normal speed, these values can be suitable changed.

Further, while in the present embodiment described above the tex screw 3 is used, the present invention is also applicable to the case where a screw other than the tex screw 3 is used.

REFERENCE NUMERALS

10 . . . rotary impact tool
11 . . . housing
18*t* . . . trigger
18 . . . main switch
20 . . . DC brushless motor
26*h* . . . hammer
27 . . . anvil
29 . . . impact sensor (impact detection means)
46 . . . control circuit (speed switching means)

The invention claimed is:

1. A rotary impact tool for use with a motor, comprising:
a hammer configured to rotate by receiving a rotational force of the motor;
an anvil configured to rotate by receiving a rotational force of the hammer;
an end tool attached to the anvil, such that if a torque of a value not less than a predetermined value is applied to the anvil from the outside via the end tool, then the hammer is disengaged from the anvil to rotate idle and applies an impact to the anvil in a rotational direction after rotating idle by a predetermined angle;
an impact detection device configured to detect impacts;
a main switch configured to adjust the rotating speed of the motor according to a pulling amount of a trigger; and
a speed switching device configured to switch the rotational speed of the motor between a low speed mode and a high speed mode,
wherein both in the low speed mode and the high speed mode, the rotational speed of the motor is adjusted according to the pulling amount of the trigger;
wherein the rotational speed in the high speed mode is higher than the rotational speed in the low speed mode when the trigger is pulled by the same amount; and
wherein if the impact detection device detects start of impact during rotation of the anvil in a tightening direction while the motor rotates in the high speed mode, then the speed switching device switches the high speed mode to the low speed mode.

2. The rotary impact tool according to claim 1, further comprising a speed adjusting mechanism capable of adjusting the rotational speed in the low speed mode between a plurality of different values.

3. The rotary impact tool according to claim 1, wherein the impact detection device comprises one of a piezoelectric sensor and an acceleration sensor.

4. The rotary impact tool according to claim 1, wherein during the rotation of the anvil in a direction opposite to the tightening direction while the motor rotates in the high speed mode, the speed switching device does not switch the rotational speed of the motor from the high speed mode to the low speed mode even in the case that the impact detection device detects an impact.

5. The rotary impact tool according to claim 1, wherein the impact detection device is configured to detect an impact based on a change in the rotational speed or a current of the motor.

6. A rotary impact tool for use with a motor, comprising:
a hammer configured to rotate by receiving a rotational force of the motor;
an anvil configured to rotate by receiving a rotational force of the hammer, such that if a torque of a value not less than a predetermined value is applied to the anvil from the outside, then the hammer is disengaged from the anvil to rotate idle and applies an impact to the anvil in a rotational direction after rotating idle by a predetermined angle;
an end tool attached to the anvil;
a main switch adjusting the rotating speed of the motor according to a pulling amount of a trigger; and a speed switching device configured to switch the rotational speed of the motor between a high speed mode and a low speed mode, so that the motor rotates in the low speed mode during the time when the hammer applies impacts to the anvil, wherein both in the high speed mode and the low speed mode, the rotational speed of the motor is adjusted according to the pulling amount of the trigger by the main switch; and wherein the rotational speed in the high speed mode is higher than the rotational speed in the low speed mode when the trigger is pulled by the same amount.

7. A rotary impact tool for use with a motor, comprising:

a hammer configured to rotate by receiving a rotational force of the motor;

an anvil configured to rotate by receiving a rotational force of the hammer, such that if a torque of a value not less than a predetermined value is applied to the anvil from the outside, then the hammer is disengaged from the anvil to rotate idle and applies an impact to the anvil in a rotational direction after rotating idle by a predetermined angle;

an end tool attached to the anvil;

a control circuit adjusting the rotating speed of the motor according to a pulling amount of a trigger; and a speed switching device coupled to the control circuit and configured to switch the rotational speed of the motor between a high speed mode and a low speed mode, so that the motor rotates in the low speed mode during the time when the hammer applies impacts to the anvil, wherein both in the high speed mode and the low speed mode, the rotational speed of the motor is adjusted according to the pulling amount of the trigger; and wherein the rotational speed in the high speed mode is higher than the rotational speed in the low speed mode when the trigger is pulled by the same amount.

* * * * *